US007799499B2

(12) United States Patent
Yamanouchi et al.

(10) Patent No.: US 7,799,499 B2
(45) Date of Patent: Sep. 21, 2010

(54) IMAGE FORMING METHOD USING ELECTROPHOTOGRAPHIC SYSTEM

(75) Inventors: Takao Yamanouchi, Kanagawa (JP); Shingo Fujimoto, Fussa (JP); Shiro Hirano, Hachioji (JP); Junya Onishi, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 522 days.

(21) Appl. No.: 11/779,151

(22) Filed: Jul. 17, 2007

(65) Prior Publication Data

US 2008/0050156 A1 Feb. 28, 2008

(30) Foreign Application Priority Data

Aug. 11, 2006 (JP) ..... 2006-219491

(51) Int. Cl.
*G03G 13/20* (2006.01)

(52) U.S. Cl. ..... 430/123.41; 430/124.1; 430/109.1; 430/110.2

(58) Field of Classification Search ..... 430/123.41, 430/124.1, 109.1, 110.2
See application file for complete search history.

(56) References Cited

U.S. PATENT DOCUMENTS 5,366,841 A * 11/1994 Patel et al. ..... 430/137.14
2004/0072089 A1* 4/2004 Kishimoto et al. ..... 430/108.2
2004/0131961 A1* 7/2004 Watanabe et al. ..... 430/108.4
2005/0254865 A1* 11/2005 Katayanagi ..... 399/324
2006/0263711 A1* 11/2006 Yuasa et al. ..... 430/108.4

FOREIGN PATENT DOCUMENTS

JP 4-202345 A * 7/1992
JP 2005326668 11/2005

OTHER PUBLICATIONS

Abstract of JP 4-202245 A, Jul. 1992.*
Machine English language translation of JP 2980673 B2 Nov. 1999.*

* cited by examiner

*Primary Examiner*—Hoa V Le
(74) *Attorney, Agent, or Firm*—Lucas & Mercanti, LLP

(57) ABSTRACT

A method of forming an image comprising: (a) developing an electrostatic latent image formed on an electrophotographic photoreceptor with an electrophotographic toner so as to obtain a toner image; (b) transferring the toner image on the electrophotographic photoreceptor to a recording paper; and (c) fixing the transferred toner image with a fixing device comprising a belt fixing member having an endless belt, wherein the electrophotographic toner comprises a polymer having a glass transition point of 20 to 40° C.; an interfacial adhesion force (Fr) between the electrophotographic toner and poly(tetrafluoroethylene) is 1 to 3.5 N; and the fixing device comprises a heating roller which is provided at a position apart from a fixing nip area.

11 Claims, 3 Drawing Sheets

IMAGE FORMING METHOD USING ELECTROPHOTOGRAPHIC SYSTEM

This application is based on Japanese Patent Application No. 2006-219491 filed on Aug. 11, 2006 in Japan Patent Office, the entire content of which is hereby incorporated by reference.

TECHNICAL FIELD

The present invention relates to an image forming method using an electrophotographic system, which is employed in copiers, printers, and facsimile machines.

BACKGROUND

In recent years, image forming apparatuses based on electrophotographic systems have been introduced in the print-on-demand and shortrun printing markets since such electrophotographic image forming systems make it possible to realize multi item/small-volume printing with small investment, at low running cost, and at low energy consumption. On the other hand, these electrophotographic systems have the problem with their limited options for usable types of paper, compared with offset printing methods, which have heretofore been used. Specifically, the electrophotographic systems are not sufficiently compatible with thick coated printing paper widely employed in catalogue and flier printing, resulting in the present situation which causes the marked decrease in their appeal as commercial products.

Further, the electrophotographic systems cause a problem that transfer media are liable to be bound onto a fixing roller in the process of forming color images with a large toner quantity such as photographic images used in the print-on-demand and shortrun printing markets.

To solve the above problems in the electrophotographic systems, there has been employed a belt fixing system capable of expanding the fixing area (the fixing nip) to transfer more heat energy on fixing, as well as a forced media peeling method as a way to prevent binding to the fixing roller (refer to Patent Document 1). Further, there has been proposed an employment of an electrophotographic toner (hereinafter referred to simply as "toner"), which may be fixed at lower heat energy, incorporating lower melting point resins and lower melting point releasing agents.

However, in the image forming method employing a belt fixing system and a toner, which incorporates the lower melting point resins and the lower melting point releasing agents, it has become clear that the following phenomena are liable to occur in cases of employing relatively thick coated printing paper, and of forming color images with a large quantity of the fixed toner: Blistering image defects caused by space forming between the toner in the fixed image area with a large toner quantity and the transfer medium, and also cyclic non-uniform glossiness caused by temperature decrease of the belt type fixing member.

(Patent Document 1) Japanese Patent Publication Open to Public Inspection (hereinafter referred to as JP-A) No. 2005-326668

SUMMARY

In view of the foregoing, the present invention has been achieved, and an object of the present invention is to provide an image forming method capable of preventing the blistering image defects caused by the bubbles between the toner in the fixed image area with a large toner quantity and the transfer medium, as well as the cyclic non-uniform glossiness caused by temperature decrease of a belt type fixing member, even in cases of employing relatively thick coated printing paper, and of forming color images with a large toner quantity.

The foregoing object of the present invention was achieved by the following methods.

(1) An embodiment of the present invention includes a method of forming an image comprising:

(a) developing an electrostatic latent image formed on an electrophotographic photoreceptor with an electrophotographic toner so as to obtain a toner image;

(b) transferring the toner image on the electrophotographic photoreceptor to a recording paper; and (c) fixing the transferred toner image with a fixing device comprising a belt fixing member having an endless belt, wherein the electrophotographic toner comprises a polymer having a glass transition point of 20 to 40° C.;

an interfacial adhesion force (Fr) between the electrophotographic toner and poly(tetrafluoroethylene) is 1 to 3.5 N; and the fixing device comprises a heating roller which is placed at a position apart from a fixing nip area.

(2) Another embodiment of the present invention includes a method of forming an image of the above-described item 1, wherein the endless belt in the belt fixing member comprises a surface layer having a fluorinated resin.

(3) Another embodiment of the present invention includes a method of forming an image of the above-described items 1 or 2, wherein the fluorinated resin in the surface layer is a tetrafluoroethylene-perfluoroalkyl vinyl ether copolymer.

DESCRIPTION OF THE PREFERRED EMBODIMENTS

Figure 1:
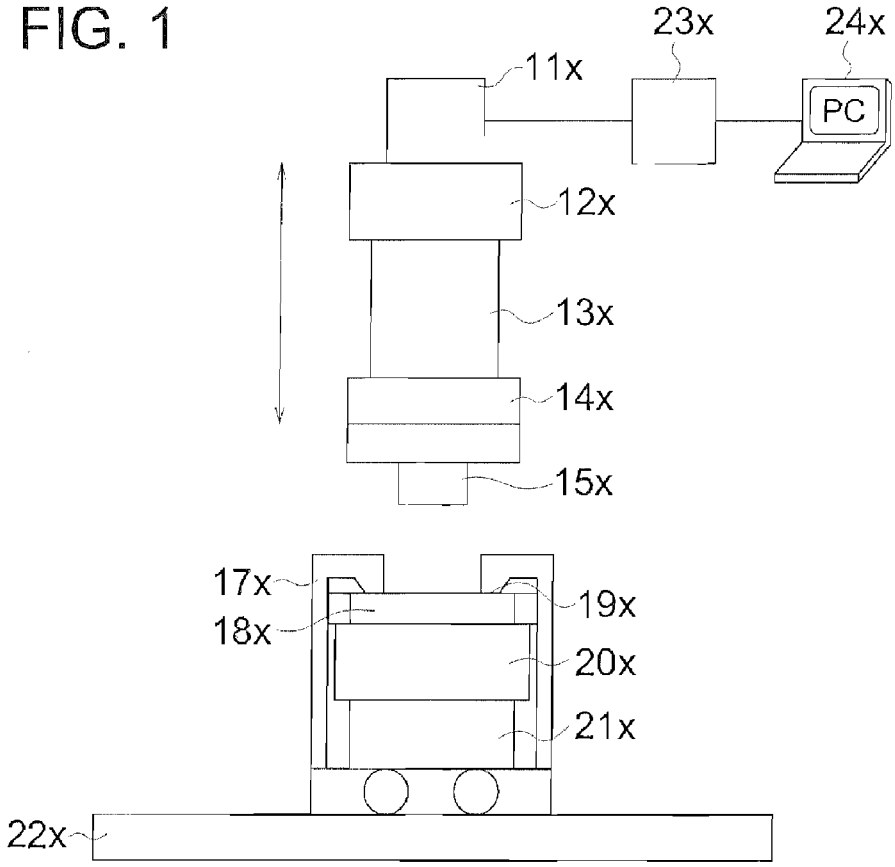
FIG. 1 is a schematic view of an example of the device to measure interfacial adhesion force (Fr) and inner aggregation force (Ft).

The image forming method of the present invention is one in which fixed toner images are formed by the following steps: electrostatic latent images formed on an electrophotographic photoreceptor are visualized employing a toner; the visualized toner images are transferred onto recording paper; and the fixed toner images are formed employing a fixing device having an endless belt (or called as a looped belt) fixing member, wherein the glass transition temperature of said toner is 20-40° C., the interfacial adhesion force (Fr) between the above toner and poly(tetrafluoroethylene) is 1-3.5 N, and the above fixing device incorporates a heating roller placed apart from the fixing nip area.

The inventors of the present invention, as a result of their diligent investigation, have found that the above problems were solved by controlling the glass transition temperature (hereinafter referred to simply as "Tg") of the toner as well as interfacial adhesion force in the optimum belt fixing system in view of securing the fixing nip area.

In cases in which color images containing a relatively large amount of toner are formed on thick coated printing paper, blistering image defects frequently result. The reason for this is presumed as follows. In cases in which bubbles are formed between the transfer medium and the toner, which has adhered to the surface of the transfer medium, it is possible for the existing bubbles to generally evaporate from paper fibers in a system employing plain paper and having lower amounts of adhered toner. However, if a relatively large quantity of the toner adheres to card board coated paper, it is impossible for the bubbles to evaporate either toward the coated paper or toward the adhered toner. Consequently, that portion of the toner image is raised with the remaining bubbles within the toner, resulting in a swollen image defects resembling blisters. Accordingly, the present invention has solved the above problems as follows. With respect to the physical properties of the toner adhering to thick coated paper, the glass transition temperature of the toner has been adjusted by 20-40° C., which makes it possible for the toner to fuse at a lower temperature, that is, resulting in exhibiting increased fusing properties. As a result, it is possible for the bubbles to evaporate toward the toner surface on fixing. The toner having Tg of 20-40° C. is likely to exhibit a high interfacial adhesion force (Fr), which may cause loss of toner image glossiness by trasnferring a part of the surface of the toner image to a roller. The above-described problem was resolved by the following. The releasing properties of the toner (Fr) have been improved by adjusting the interfacial adhesion force to be within 1.0-3.5 N in order to improve peeling property of the surface of the toner image containing bubbles formed during heating.

On the other hand, the occurrence mechanism of cyclic non-uniform glossiness is as follows: when toner images, of a large quantity of adhered toner on thick coated printing paper, are fixed in a fixing device incorporating a heating roller apart from the fixing nip area, the image unevenness phenomena occur due to heating unevenness on the belt caused by heat being released from the belt between the heating roller and the fixing nip, as well as caused by heat transfer unevenness resulting from the thick coated paper in the fixing nip and from the toner layer with a large quantity of the adhered toner. Accordingly, the present invention has solved the problems as follows: Minimizing the dependence of image glossiness on the fixing temperature in order to prevent the cyclic non-uniform glossiness, that is, designing the toner to have Tg of 20-40° C. and Fr of 1.0-3.5 N so as for the glossiness not to markedly vary even when the fixing temperature decreases.

The problem-solving factor is assumed to be as follows. The aggregation force in the interior of the toner is enhanced since the resin, exhibiting a higher Tg than that of the toner binding resin employed to control interfacial adhesion force, is dispersed in the interior of the toner particles. As a result, the toner surface does not vary readily even if the fixing temperature decreases slightly, whereby the non-uniform glossiness is minimized.

The present invention and embodiments thereof will now be detailed.

(Toner Employed in the Present Invention)

With respect to the toner of the present invention, the glass transition temperature thereof is preferably in the range of 20-40° C., but more preferably in the range of 30-40° C. Further, the interfacial adhesion force (Fr) to poly(tetrafluoroethylene) (PTFE) is preferably 1.0-3.5 N, and is more preferably 1.0-3.0 N.

It is possible to decrease Tg of a polystyrene copolymer resin by increasing a ratio of a monomer having lower Tg than Tg of polystyrene. Examples of such monomers are: propyl acrylate, propyl methacrylate, butyl acrylate, butyl methacrylate, 2-ethylhexyl acrylate, and 2-ethylhexyl methacrylate. A preferred ratio of the above-described monomer is 8-80 wt %, more preferably 9-70 wt % based on the weight of polystyrene.

The interfacial adhesion force (Fr) between the toner and the PTFE is the force for peeling toner from the PTFE after allowing a member, the surface of which has been coated with PTFE, to adhere to the toner fused at an appropriate temperature.

The Tg control of the toner is conducted by changing the monomer compositions of the binding resins. It is effective to increase the amount of acryl resins, which are components capable of increasing the inner aggregation force of the toner while decreasing Tg.

Further, the interfacial adhesion force is controlled by such ways to control wax types, wax contents, compositions and molecular weight design of the binding resins composing the toner, and structure design of the interior of the toner. Of these, the critical factors are composition and molecular weight design of the binding resins composing the toner, as well as the structure design of the interior of the toner. Herein, the structure design of the interior of the toner means designing the present state of the resins, that is, designing how to allow the resins, each having different properties, to co-exist in the interior of the toner. The following methods may be exemplified: Forming a core/shell structure via allowing resin particles exhibiting higher glass transition temperatures than that of the whole toner to exist near the toner surface, and allowing resins exhibiting higher Tg to exist in the interior of the toner in a dispersed state.

(Determination of Glass Transition Temperature)

The glass transition temperature of the toner of the present invention may be measured via DSC-7 differential scanning calorimeter (manufactured by PerkinElmer) and TAC7/DX thermal analyzer controller (manufactured by PerkinElmer).

Measurement was carried out by the following procedures: The weight of collected toner, weighing 4.5-5.0 mg, was precisely determined to two decimal places. The resultant sample was sealed in an aluminum pan (Kit No. 0219-0041) and placed in a DSC-7 sample holder. An empty aluminum pan was used as the reference measurement. Subsequently, heating-cooling-heating temperature control was carried out for a temperature range of 0-200° C., a temperature increasing rate of 10° C./minute, and a temperature decreasing rate of 10° C./minute.

With regard to the glass transition temperature, the intersection of the extension of the base line prior to the initial rise of the first endothermic peak with the tangent which shows the maximum inclination between the initial rise of the first peak and the summit of the above peak is represented as the glass transition point.

(Measurement of Interfacial Adhesion Force)

FIG. 1 is a schematic view of an example of a measuring device of interfacial adhesion force (Fr).

In FIG. 1, 11*x* represents an elevating axis, 12*x* represents a load cell, 13*x* represents a heat insulating member, 14*x* represents a heating member (a panel heater), 15*x* represents a head section, 17*x* represents a holding member, 18*x* a toner pellet, 19*x* represents the contact surface, 20*x* represents a mounting member, 21*x* represents a spring, 22*x* represents a base, 23*x* represents a data input device, and 24*x* represents a data analyzer.

(Interfacial Adhesion Force)

Figure 2:
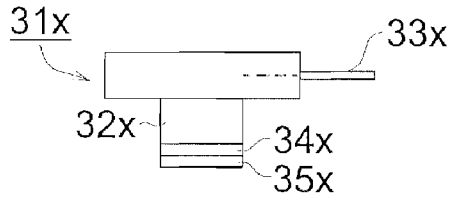
FIG. 2 is a schematic view of a head for measuring the interfacial adhesion force (Fr)

Interfacial adhesion force between the toner and the PTFE was determined via mounting the head illustrated in FIG. 2 onto head section 15*x* illustrated in FIG. 1.

FIG. 2 is a schematic view of the head for measuring interfacial adhesion force (Fr).

In FIG. 2, 31*x* represents a head section for measuring Fr, 32*x* represents a cylindrical head, 33*x* represents a thermocouple, 34*x* represents a heat resistant double-coated tape, and 35*x* represents a member coated with PTFE. The member, coated with PTFE, is prepared by coating PTFE at a layer thickness of 20-30 μm onto 0.5 mm thick silicone rubber.

The measuring device is, for example, composed of a toner pellet fixing member, a tension and pressing member (namely the head), and a pressure and temperature controller as shown in FIG. 1. Such devices are classified into tensile strength testers or an elongation viscosity measuring devices.

The toner to be measured is press molded to form pellets. Since the toner pellets are deformed during pressing, parallelism of the upper and lower surfaces thereof is not secured. Therefore, the measuring device is configured so that the toner pellet may be pushed up from below in order for the upper surface thereof to come into contact with the datum plane of the measuring device. Further, since the pressure sensor (the load cell) is subjected to effects due to heat, a three-step insulation is carried out. A panel heater is employed to heat the head, and heat is controlled via a thermocouple placed within the head.

To prepare the measurement, in the first place, the member, whose surface had been coated with PTFE, was adhered to the cylindrical head (aluminum A5052 at a diameter of 8 mm) on the head section using heat resistant double-coated tape. Further, the heating member (a panel heater) was inserted into the screw part provided in the insulating medium, and the above head was screw-fixed. A thermocouple was inserted to the very bottom of the hole provided in the head section. A temperature controller "E5CN-RTC" (manufactured by OMRON Corp.) was turned on, and then the measurement temperature was set. Prior to the measurement, the PTFE surface was wiped with tetrahydrofuran, and then the toner pellet, which had been prepared as follows, was attached. Two grams of the toner, which had been allowed to stand for 24 hours at a temperature of 24±1° C. and at a humidity of 50±5% RH, was placed within a circular vinyl chloride ring of an inner diameter of 34.5 m, and the toner was pressed for 10 seconds at a pressure of 150 kg using a powder compression device.

When the temperature reached the predetermined value, measurement was initiated under the following conditions. A measured value was read off at the maximum load cell voltage. A numeric value, which had been obtained by converting the measured value into pressure, represented the interfacial adhesion force.

Head descending rate: 1 mm/second

Head pressure: 0.1 N

Head pressure retention time: 1 second

Head lifting rate: 50 mm/second

Measurement ambience: 24±1° C., 50±5% RH

In the present invention, three interfacial adhesion force values were measured at temperatures of 160° C., 170° C., and 180° C. The average value of the above three measured values was used as an interfacial adhesion force Fr).

(Toner Production Method)

Toner production methods are not particularly limited as long as the produced toner exhibits a glass transition temperature range of 20-40° C. and an interfacial adhesion force between the PTFT and the toner ranges from 1.0-3.5 N. Examples of the production methods include a suspension polymerization method, an emulsion aggregation method, a dispersion polymerization method, a dissolution suspension method, a fusion method, and a kneading pulverization method. Of these, in view of ease of the internal structure design of toner, the emulsion association method is preferably employed. Specific examples of structure design methods of the interior of the toner in the emulsion aggregation method include (a) a method in which a core/shell structure is formed by allowing resin particles for the shell to adhere to and to fuse with the prepared core particles, (b) a method in which a core/shell structure is formed by allowing hydrophobic resins to be present in the interior of the toner and hydrophilic resins to be present near the toner surface, by means of aggregating and fusing the binding resins in the presence of the hydrophobic resins and the hydrophilic resins, and (c) a method in which Resin particles B, whose characteristics differ from Resin Particles A, is added to Resin Particles A during the growing process of Resin Particles A in the aggregation process of the resin particles, and furthermore the particles are allowed to continue growing, whereby Resin particles B are incorporated into Resin Particles A in a dispersion state.

As a method of producing the toner of the present invention, one specific example, which employs the above methods (b) and (c) in the emulsion aggregation method, is described as follows: (1) a dissolution/dispersion process in which releasing agents are dissolved in or dispersed into radically polymerizable monomers, (2) a polymerization process in which the dispersion of Resin Particles A incorporating releasing agents, hydrophilic resins, and hydrophobic resins is prepared, (3) an aggregation process in which aggregated particles are formed by aggregating resin particles and colorants in an aqueous medium, (4) an aggregation process in which toner particles with a core/shell structure are prepared by orienting the hydrophilic resins to the surface of the toner particles and the hydrophobic resins in the interior thereof by means of the process of fusing and ripening the aggregated particles employing thermal energy, and also Resin Particles B are added to Resin Particles A during the growing process of the latter, and aggregation is terminated after being continued, (5) a fusing process in which the toner particles (associative particles) are formed by fusing the aggregated particles employing thermal energy, (6) a cooling process which cools the toner host particles dispersion, (7) a washing process in which the above toner host particles are subjected to solid-liquid separation whereby surface active agents are removed from the above toner host particles, (8) a drying process which dries the washed toner host particles, and (9) a process in which any appropriate external additives are added to the dried toner host particles.

Each of the processes is further be detailed below.

(Dissolution-Dispersion Process)

This process is one which prepares a radically polymerizable monomer solution by dissolving releasing agents in, or by dispersing the same into, radically polymerizable monomers.

(Polymerization Process)

In one appropriate example of this polymerization process, the above radically polymerizable monomer solution, which incorporates the dissolved or dispersed releasing agents, is added to an aqueous medium incorporating surface active agents, followed by formation of oil droplets via application of mechanical energy, and subsequently, a polymerization reaction is performed in the above oil droplets via radicals derived from water-soluble radical polymerization initiators. Resin particles, as nucleus particles, may be added to the above aqueous medium, and the polymerization process may be carried out through several steps.

In this polymerization process, resin particles are prepared incorporating releasing agents, hydrophilic resins, and hydrophobic resins. These resin particles may, or may not, be colored. The colored resin particles are prepared by polymerizing monomer compositions incorporating colorants. Further, when non-colored resin particles are employed, a colorant particle dispersion is added to the resin particle dispersion, whereby toner particles are formed by fusing the resin particles and the colorant particles in this fusion process, described below.

(Aggregation-Fusion Process)

Salting-out agents composed of alkaline metal salts or alkaline earth metal salts are added as aggregating agents to an aqueous medium in which resin particles and colorant particles, if desired, are present at a concentration equal to or more than the critical aggregation concentration to form aggregated particles. Further, in this aggregation process, it is possible to aggregate internal additives such as releasing agent particles, charge controlling agents, and resin particles with different heat properties, together with the resin particles and the colorant particles.

In particular, after being initiated, aggregation of Resin Particles A are continued until the particles grow to the targeted particle diameter. For example, in cases of preparing toners of a volume-based median diameter ($D_{50}$) of 6 μm, aggregation is continued until the particle diameter of Resin Particles A grows to 30-70% of the toner particle diameter. At this stage, a dispersion of Resin Particles B is added. It is preferable that Tg of Resin Particles B be higher than that of Resin Particles A. Further, it is desirable that the added amount of Resin Particles B be 10-80% by weight with respect to Resin Particles A.

After the dispersion of Resin Particles B is added, aggregation is further continued to grow the particles to the targeted particle diameter. After aggregation is terminated, Resin Particles B are incorporated into Resin Particles A.

In this process, in cases in which both hydrophilic resins and hydrophobic resins are present in Resin Particles A, the toner host particles having a core/shell structure may be formed via orienting the hydrophilic resins toward the surface of the particles and the hydrophobic resins toward the interior thereof.

(Ripening Process)

Ripening means that preparation of the shape of the above aggregated and fused toner is continued until the appropriate degree of circularity is realized. It is preferable that the ripening process is carried out by a method employing thermal energy (heating).

(Cooling Process)

This process is one in which the above toner host particle dispersion is cooled. The cooling treatment is carried out at a cooling rate of 1-20° C./minute. Methods of the cooling treatment, although not specifically limited, may include a method of cooling via feeding a cooling medium from the exterior of the reaction vessel, and a method of cooling by directly placing chilled water into the reaction system.

(Solid-Liquid Separation and Washing Process)

In the solid-liquid separation and washing process, the following treatments are applied: A solid-liquid separation treatment of separating the toner host particles from the toner host particle dispersion, which has been cooled down to a predetermined temperature in the above process, and a washing treatment of removing deposits such as the surfactant and the salting-out agent from a toner cake (an accumulated substance with a cake-shape formed by aggregating the toner particles in a wet state) obtained by the solid-liquid separation. Herein, filtration methods include a centrifugal separation method, a vacuum filtration method carried out employing a Buchner funnel, and a filtration method carried out employing a filter press, but the filtration methods are not specifically limited.

(Drying Process)

This process is one in which the washed toner cake is dried to prepare dried toner host particles. Examples of driers employed in this process include spray driers, vacuum freeze driers, and vacuum driers. It is preferable to employ any of the stationary tray drier, transportable tray drier, fluid layer drier, rotary type drier and stirring type drier. The moisture in the dried toner particles is preferably at most 5% by weight, but is more preferably at most 2% by weight. When the dried toner host particles are aggregated via weak attractive force among the particles, the above aggregates may be pulverized. Herein, mechanical pulverizing apparatuses such as a jet mill, a HENSCHEL mixer, a coffee mill, or a food processor may be employed as a pulverizing method.

(External Additive Treatment Process)

This process is one in which toners are prepared, if desired, by mixing external additives in the dried toner host particles. Mechanical mixers such as a HENSCHEL mixer or a coffee mill may be employed as a mixer for the external additives.

In the toner according to the present invention, in order to result in the effect in which the above large diameter external additives are not buried due to the spacer effect, it is preferable that toner host particles are nearly spherical. Further, in order to simultaneously realize targeted cleaning capability, degree of circularity, determined via FPIA2100, is preferably 0.950-0.980. Incidentally, degree of circularity of toner particles refers to the value determined via "FPIA-2100" (produced by Sysmex Co.).

<Determination of Degree of Circularity>

Specifically, toner is allowed to be more wettable by employing an aqueous surface active agent solution and is subjected to ultrasonic dispersion over one minute. Thereafter, by employing "FPIA-2100", determination is carried out at an optimum concentration of HFP detecting number of 3,000-10,000 at determination condition HPF (high magnification imaging) mode. Under such range, it is possible to obtain identical reproducible termination values. Thus, the degree of circularity defined by the following formula was determined.

Degree of circularity=(circumference of a circle having the same projective area as a particle image)/(circumference of projective area of the particle)

Further, average degree of circularity refers to the following value. Degree of circularity of each of the particles is totaled and the resulting value is divided by the number of total particles.

The diameter of toner particles of the present invention is preferably 3-8 μm in terms of number average particle diameter. When toner particles are formed via a polymerization method, it is possible to control the above particle diameter depending on: concentration of aggregating agents, added amount of organic solvents, fusion duration, and composition of the polymer itself in the above toner production method.

By realizing a number average particle diameter of 3-8 μm, it is possible to not only achieve targeted reproduction of fine lines and high quality of photographic images but also to decrease the toner consumption compared to the case employing relatively large diameter toner particles.

Compounds (binding resins, colorants, releasing agents, charge controlling agents, and external additives), which constitute toner, will now be described.

(Binding Resins)

It is possible to employ resins known in the art as polymerizable monomers which form Resin Particles A and Resin Particles B which constitute binding resins. Specifically, it is preferable that styrene, acrylic acid or methacrylic acid derivatives, and those having an ionic dissociating group are employed in combination.

Those, which are employed as polymerizable monomers which constitute resin particles, include styrene or styrene derivatives such as styrene, o-methylstyrene, m-methylstyrene, p-methylstyrene, α-methylstyrene, p-chlorostyrene, 3,4-dichlorostyrene, p-phenylstyrene, 2,4-dimethylstyrene, p-tert-butylstyrene, p-n-hexylstyrene, p-n-octylstyrene, p-n-nonylstyrene, p-n-decylstyrene, or p-n-dodecylstyrene; methacrylate derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, dimethylaminoethyl methacrylate, or dimethylaminoethyl methacrylate; acrylate derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, or phenyl acrylate; olefins such as ethylene, propylene, or isobutylene; halogen based vinyls such as vinyl chloride, vinylidene chloride, vinyl fluoride, or vinylidene fluoride; vinyl esters such as vinyl propionate, vinyl acetate, or vinyl benzoate; vinyl ethers such as vinyl methyl ether or vinyl ethyl ether; vinyl ketones such as vinyl methyl ketone, vinyl ethyl ketone, or vinyl hexyl ketone; N-vinyl compounds such as N-vinylcarbazole, N vinylindole, or N-vinylpyrrolidone; vinyl compounds such as vinylnaphthalene or vinylpyridine; and acrylic or methacrylic derivatives such as acrylonitrile, methacrylonitrile, or acrylamide. These vinyl based monomers may be employed individually or in combination.

Further, it is further preferable to simultaneously employ those having an ionic dissociating group as a polymerizable monomer constituting resins, which are exemplified as ones having a carboxyl group, a sulfonic acid group, and a phosphoric acid group. Specific examples include acrylic acid, methacrylic acid, maleic acid, itaconic acid, cinnamic acid, fumaric acid, monoalkyl maleate, monoalkyl itaconate, styrene sulfonic acid, allylsulfocinnamic acid, 2-acrylamido-2-methylpropnaesulfnic acid, acid phosphoxyethyl acrylate, and 3-choro-2-acid phosphoxypropyl methacrylate.

Further, it is possible to produce crosslinking structured resins employing polyfunctional vinyls such as divinylbenzene, ethylene glycol methacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, or neopentyl glycol diacrylate.

It is also possible to polymerize these polymerizable monomers employing radical polymerization initiators. In such case, in a suspension polymerization method, it is possible to employ oil-soluble polymerization initiators. Such oil-soluble polymerization initiators include diazo based polymerization initiators such as 2,2'-azobis-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, or azobisisobutyronitrile, peroxide based polymerization initiators such as benzoyl peroxide, methyl ethyl ketone peroxide, diisopropyl peroxycarbonate, cumene hydroperoxide, t-butylhydro peroxide, di-t-butyl peroxide, dicumyl peroxide, 2,4-dichlorobenzoyl peroxide, lauroyl peroxide, 2,2-bis-(4,4-t-butylpeoxycyclohexyl)propane, tris-(t-butylperoxy)triazine and polymer initiators having a peroxide in the side chain.

Further, when an emulsion polymerization method is employed, it is possible to also employ water-soluble radical polymerization initiators, which may include persulfates such as potassium persulfate or ammonium persulfates, as well as azobisaminodipropane acetate, azobiscyanovaleric acid or salts thereof, and hydrogen peroxide.

To form Resin Particles B, it is preferable that polymerizable monomers are combined so that the glass transition temperature is higher than that of Resin Particles A.

It is possible to determine the glass transition temperature (Tg) according to the present invention, employing differential scanning calorimeter "DSC-7" (produced by PerkinElmer) and thermal analyzer controller "TAC 7/DX" (produced by PerkinElmer).

Operational procedures are as follows. A sample to be determined in an amount of 4.5-5.0 mg is collected, precisely weighed to two of decimal places, sealed in an aluminum pan (Kit No. 0219-0041), and placed in "DSC-7 sample holder. An empty aluminum pan was employed as a reference. Determination was carried out under conditions of the determination temperature range of 0-200° C., a temperature increasing rate of 10° C./minute, a temperature decreasing rate of 10° C./minute, and a heating-cooling-heating temperature control. Analysis was conducted based on data at the 2nd heat.

With regard to the glass transition temperature, the intersection of the extension of the base line prior to the initial rise of the first endothermic peak with the tangent which shows the maximum inclination between the initial rise of the first peak and the summit of the above peak is represented as the glass transition point.

(Colorants)

It is possible to employ, as the colorants of the present invention, inorganic or organic types known in the art.

Examples employed as a black colorant include carbon blacks such as furnace black, channel black, acetylene black, thermal black, or lamp black, as well as magnetic powders such as magnetite or ferrite.

Further, colorants for magenta or red include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48; 1, C.I. Pigment Red 53; 1, C.I. Pigment Red 57; 1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222.

Still further, colorants for orange or yellow include C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 74, C.I. Pigment Yellow 93, and C.I. Pigment Yellow 138.

Still further, colorants for green or cyan include C.I. Pigment Blue 15, C.I. Pigment Blue 15; 2, C.I. Pigment Blue 15; 3, C.I. Pigment Blue 15; 4, C.I. Pigment Blue 16, C.I. Pigment Blue 60, C.I. Pigment Blue 62, C.I. Pigment Blue 66, and C.I. Pigment Green 7.

These colorants may be employed individually or in combinations of at least selected two types. Further, the added amount of colorants is commonly in the range of 1-30% by weight with respect to the total weight, but is preferably in the range of 2-20% by weight.

(Releasing Agents)

Employed as releasing agents in the present invention may be the compounds known in the art.

Examples of such compounds include olefin waxes such as polyethylene wax or polypropylene wax; long chain hydrocarbon based waxes such as paraffin wax or Sasol wax; dialkyl ketone based waxes such as distearyl ketone; ester based waxes such as carnauba wax, montan wax, trimethylolpropane tribehenate, pentaerythritol tetrabehenate, pentaerythritol diacetate dibehenate, glycerin tribehenate, 1,18-ictadecanediol distearate, tristearyl trimelliate, distearyl maleate, and amido based waxes such as ethylenediaminebehenylamide, trimellitic acid tristearylamide. Among the aforementioned waxes, preferred waxes for the present invention are long chain hydrocarbon based waxes and ester based waxes. The preferred melting point of the wax used in the present invention is in the low temperature of 50-90° C. in order to achieve uniform coverage on the surface of the toner image during the fixing step.

The amount of releasing agents incorporated in toner is preferably 1-20% by weight with respect to the total toner, but is more preferably 3-15% by weight.

(Charge Controlling Agents)

If desired, added to the toner according to the present invention may be charge controlling agents.

(External Additives)

Other than the above minute inorganic particles exhibiting specified physical properties, added to the toner according to the present invention may be so-called external additives (also referred to "external addition agents") to improve fluidity and electrification property and to enhance cleaning properties. These external additives are not particularly limited, and various minute inorganic and organic particles, as well as lubricants, may be employed.

Other than the above minute inorganic particles exhibiting specified physical properties according to the present invention, it is preferable to employ various inorganic oxide particles such as silica, titania or alumina. Further, it is preferable that these minute inorganic particles be subjected to a hydrophobic treatment employing silane coupling agents or titanium coupling agents. Still further employed as minute organic particles may be spherical ones at a number average diameter of the primary particles of about 10-2,000 nm. Employed as such minute organic particles may be those composed of polymers such as polystyrene, polymethyl methacrylate, or styrene-methyl methacrylate copolymer.

The addition ratio of these external additives in the toner is commonly 0.1-5.0% by weight, but is preferably 0.5-4.0% by weight. Further, various external additives may be employed in combinations.

(Developers)

The toner according to the present invention may be employed as a single component toner or a double component toner.

When employed as a single component toner, listed is a non-magnetic single component toner or a magnetic single component toner which is prepared by incorporating magnetic particles of a size of about 0.1-about 0.5 μm into toner. Either of them may be employed.

Further, toner is mixed with carriers, and the resulting mixture is employed as a double component toner. Employed as the above carriers may be magnetic particles known in the art, such as those composed of metals such as iron, ferrite, or magnetite or alloys of the above metals with metals such as aluminum or lead. Specifically preferred are ferrite particles. The particle diameter of the above carriers is preferably 20-100 μm, but is more preferably 25-80 μm.

It is possible to determine the diameter of carrier particles by employing laser diffraction system particle size distribution meter "HELOS" (produced by SYMPATEC Co.).

Preferred carriers may be those which are prepared by coating resins onto magnetic particles, or so-called resin dispersion type carriers which are prepared by dispersing magnetic particles into resins. Resins for such coating are not particularly limited. Examples of usable resins include olefin based resins, styrene based resins, styrene-acryl based resins, silicone based resins, ester based resins, and fluorine-containing polymer based resins. Further, resins to constitute the resin dispersion type carriers are also not particularly limited, and any of those known in the art may be employed. Usable examples include styrene-acryl based resins, polyester resins, fluorine based resins, and phenol resins. Of these, more preferred are carries coated with styrene-acrylic resins, since it is possible to minimize releasing of external additives and to realize targeted durability.

(Image Forming Method)

Figure 3:
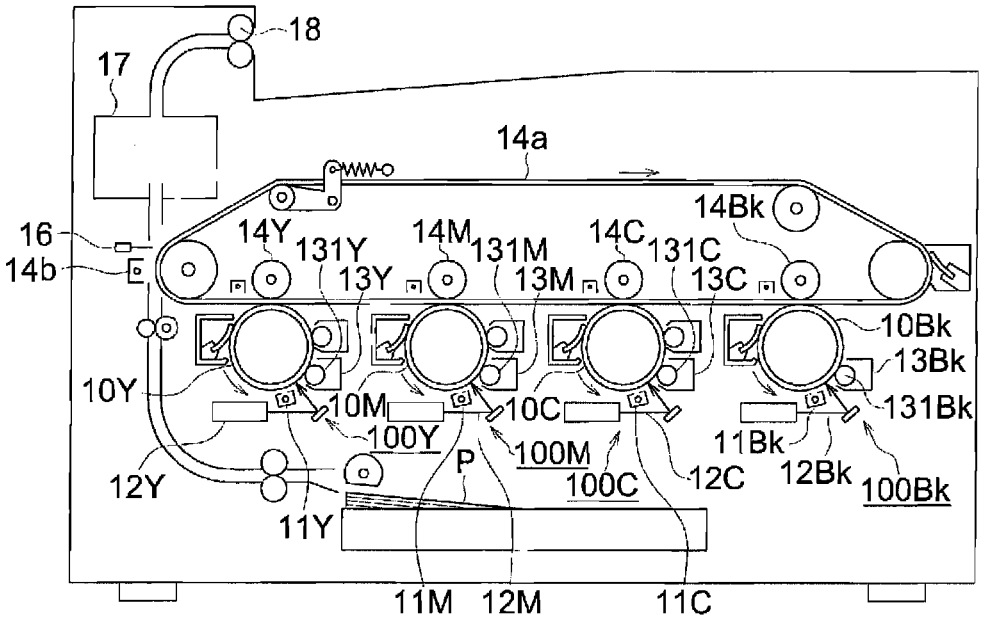
FIG. 3 is an explanatory view of an example of an image forming apparatus using the toner according to the present invention.

FIG. 3 is an explanatory view showing one example of the image forming apparatus realizing the image forming method employing the toner according to the present invention.

The above image forming apparatus is a tandem system color image forming apparatus structured in such a manner that four groups of image forming units 100Y, 100M, 100C, and 100Bk are arranged along intermediate belt 14*a* which functions as an intermediate transfer medium.

Each of image forming units 100Y, 100M, 100C, and 100Bk is formed in such a manner that a photoconductor layer composed of a conductive layer and an organic photosensitive compound (OPC) are formed on the outer circumference of a cylindrical substrate, and is driven by power from a driving source (not shown) or via intermediate belt 14*a*. Further, each unit is composed of photoreceptor drums 10Y, 10M, 10C, and 10Bk which rotate counterclockwise while the conductive layer is grounded, charging member 11Y, 11M, 11C, and 11Bk which are arranged in the right angles to the moving direction of photoreceptor drum 10Y, 10M, 10C, and 10Bk, and provide uniform potential on the surface of the above photoreceptor drums 10Y, 10M, 10C, and 10Bk, exposure member 12Y, 12M, 12C, and 12Bk which form latent images via image exposure onto the surface of uniformly charged photoreceptors 10Y, 10M, 10C, and 10Bk in such a manner that scanning is carried out in parallel to the rotation axis of each of photoreceptor drums 10Y, 10M, 10C, and 10Bk employing, for example, a polygonal mirror, rotating development sleeves 131Y, 131M, 131C, and 131Bk, and development member 13Y, 13M, 13C, and 13Bk which convey each of the retained toners to the surface of photoreceptor drums 10Y, 10M, 10C, and 10Bk.

Herein, yellow toner images are formed via image forming unit 100Y, magenta toner images are formed via image forming unit 100M, and cyan toner images are formed via image forming unit 100C, while black toner images are formed via image forming unit 100Bk.

In the above image forming apparatus, each of the color toner images formed on each of photoreceptor drums 10Y, 10M, 10C, and 10Bk of each of image forming unit 100Y, 100M, 100C, and 100Bk is sequentially transferred and superimposed onto transfer medium P which is synchronously conveyed via transfer member 14Y, 14M, 14C, and 14

Bk, whereby a color toner image is formed. The resulting color toner image is transferred onto transfer medium P in secondary transfer member 14*b*, and the resulting transfer media P is separated from intermediate belt 14*a* by a separation member 16, followed by fixing in fixing device 17 and discharge from discharge outlet 18 to the exterior of the apparatus.

(Fixing Device)

The fixing device employed in the present invention is one incorporating an endless belt fixing member and in addition, a heating roller arranged away from the fixing nip region.

Figure 4:
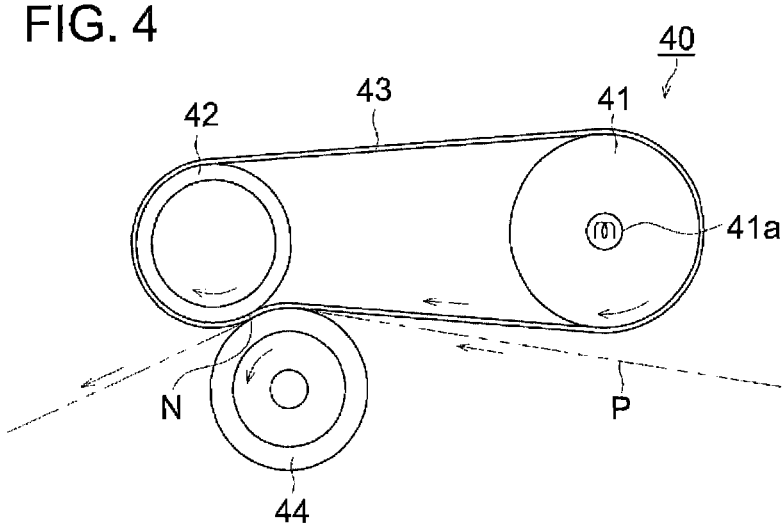
FIG. 4 is a cross-sectional view of an example of the composition of a fixing device in the image forming apparatus.

FIG. 4 is an explanatory view showing one example of the structure of a fixing device in an image forming apparatus in which the toner according to the present invention is employed.

The above fixing device 40 incorporates heating roller 41 having heating source 41*a* composed of halogen lamps, supporting roller 42 which is positioned parallel to but away from the above heating roller 41, endless (or looped) fixing belt 43 entrained between heating roller 41 and supporting roller 42, and facing roller 44 which is brought into pressure contact with supporting roller 42 via the above fixing belt 43 to form fixing nip section N.

Fixing belt 43 is structured as follows. A Si rubber layer at a wall thickness of about 200 μm is formed on the peripheral surface of a Ni electroforming substrate at a wall thickness of about 40 μm or a polyimide substrate at a wall thickness of 50-100 μm. Further, it is preferable that a surface layer at a wall thickness of about 30 μm is formed on the peripheral surface of the above Si rubber layer. The above surface layer is preferably composed of fluorine based resins, examples of which include PFA (being a tetrafluoroethylene-perfluoroalkyl vinyl ether copolymer) and PTFE (being polytetrafluoroethylene), but more preferred is PFA (being a tetrafluoroethylene-perfluoroalkyl vinyl ether).

In the fixing device shown in FIG. 4, the side (the upper side) which comes into contact with toner images is composed of an endless belt fixing member. However a fixing device may be acceptable in which, on the contrary, the endless belt fixing member is located on the lower side.

Figure 5:
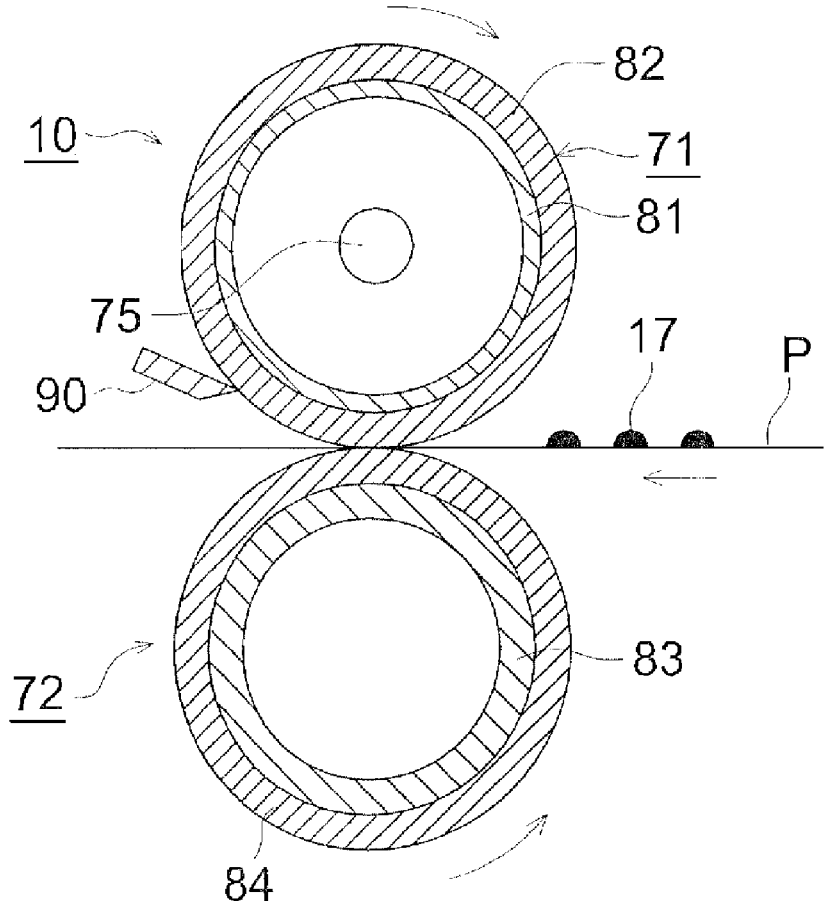
FIG. 5 is a cross-sectional view showing a fixing device used for carrying out an evaluation test.

FIG. 5 is a cross-sectional view showing a fixing device (a type using a pressure roller and a heating roller) used in the evaluation for this invention.

Fixing device 10 shown in FIG. 5 is equipped with heating roller 71 and pressure roller 72 which gives pressure to heating roller 71. In addition, in FIG. 5, 90 is a separation claw, 17 is a toner image formed on transferring medium P (a transferring paper).

Heating roller 71 is made of cored bar 81 having covering layer 82 containing a fluorinated resin and an elastic material, and heating member 75 made of a wire heater is incorporated in heating roller 71.

Cored bar 81 is made of aluminum having an inner diameter of 70 mm.

The wall thickness of cored bar 81 is 0.8 mm.

As fluorine resin used for the surface of covering layer 82 is PTFE (polytetrafluoroethylene).

The thickness of covering layer 82 comprised of PTFE is 30 μm.

Moreover, it is desirable to use a silicone rubber as an elastic material for covering layer 82.

Moreover, the thickness of covering layer 82 composed of an elastic material is 200 μm.

As a heating source in heating member 75, a halogen heater is used.

Pressure roller 72 is comprised of cored bar 83 the surface of which is made of covering layer 84 made of an elastic material. The elastic material used for covering layer 84 is a silicone rubber.

The thickness of covering layer 84 is 200 μm.

The fixing temperature (a surface temperature of heating roller 71) is set to be 160° C., the fixing line speed is set to be 230 mm/sec, the same speed as the fixing devices 1 and 2. The nip width of the heating roller is set to be 8 mm.

Separation craw 90 is provided in order to prevent the transferring material from winding around the heating roller after the toner image has been fixed on the transferring material.

Although 0.3 mg or less silicone oils per one print may be applied on the heating roller, the fixing device 10 of FIG. 5 does not use an oil (oilless).

(Transfer Media)

Transfer media, on which images employing the toner of the present invention are formed, are supports carrying toner images and are not particularly limited. However, problematic thick coated papers include POD GROSS COAT (at 128 g/m$^2$, produced by Oji Paper Co., Ltd.), OK TOP COAT+ (at 127.9 g/m$^2$, produced by Oji Paper Co., Ltd.), OK KINFUJI+ (at 157 g/m$^2$, produced by Oji Paper Co., Ltd.), HAMMERMILL COLOR COPY GLOSSY (at 135 g/m$^2$), XEROX DIGITAL COLOR COLOTECH+ GLOSS COATED (at 140 g/m$^2$).

EXAMPLES

The present invention will now be detailed with reference to examples; however, the present invention is not limited thereto.

(Preparation of Toner Host Particles 1)

(Production of Resin Particles A)

First Stage Polymerization

Placed in a 5 L reaction vessel fitted with a stirrer, a thermal sensor, a cooling pipe, and a nitrogen introducing unit were 8 g of sodium dodecylsulfate and 3 L of ion-exchanged water, and while stirring at 230 rpm under a nitrogen flow, the resulting mixture was heated so that the internal temperature reached 80° C. After the rise in temperature, a solution which was prepared by dissolving 10 g of potassium persulfate in 200 g of ion-exchanged water, and subsequently, the solution temperature was again elevated to 80° C. After dripping the following monomer mixture solution over one hour, the resulting mixture was heated at 80° C. for two hours to result in polymerization, whereby resin particles were produced. The resulting resin particles were designated as "Resin Particles (1H)".

| | |
|---|---|
| Styrene | 480 g |
| n-Butyl acrylate | 250 g |
| Methacrylic acid | 68.0 g |
| n-Octanethiol | 16.0 g |

Second Stage Polymerization

Placed in a 5 L reaction vessel fitted with a stirrer, a thermal sensor, a cooling pipe, and a nitrogen introducing unit was a solution which was prepared by dissolving 7 g of polyoxyethylene (2) sodium dodecylethersulfate in 800 ml of ion-exchanged water, which was heated to 98° C. Thereafter, 260 g of the above Resin Particles (1H) and a solution, which was prepared by dissolving the following monomer at 90° C., were added. The resulting mixture was mixed and dispersed for one hour, employing mechanical system homogenizer CLEAR MIX (produced by M Technique Co., Ltd.) for one hour, whereby a dispersion containing emulsified particles (oil droplets) was prepared.

| | |
|---|---|
| Styrene | 223 g |
| n-Butyl acrylate | 142 g |
| n-Octanethiol | 1.5 g |
| Polyethylene wax (having a melting point of 70° C.) | 190 g |

Subsequently added to the resulting dispersion was an initiator solution which was prepared by dissolving 6 g of potassium persulfate in 200 ml of ion-exchanged water. The resulting mixture was heated at 82° C. over one hour while stirring to result in polymerization, whereby resin particles were produced. The resulting resin particles were designated as "Rein Particles (1HM)".

Third Stage Polymerization

Further a solution which was prepared by dissolving 11 g of potassium persulfate in 400 ml of ion-exchanged water was added, and the monomer mixing solution of the following formula was dripped over one hour under a temperature condition of 82° C.

| | |
|---|---|
| Styrene | 405 g |
| n-Butyl acrylate | 162 g |
| Methacrylic acid | 33 g |
| n-Octanethiol | 8 g |

After dripping, the resulting mixture was heated while stirring over two hours to result in polymerization and then cooled to 28° C., whereby resin particles were produced. The resulting resin particles were designated as "Reins Particles A".

Some of Resin Particles A were collected, washed and dried, and Tg was then determined, resulting in 21° C.

(Production of Resin Particles B)

Placed in a 5 L reaction vessel fitted with a stirrer, a thermal sensor, a cooling pipe, and a nitrogen introducing unit were 2.3 g of sodium dodecylsulfate and 3 L of ion-exchanged water, and while stirring at 230 rpm under a nitrogen flow, the resulting mixture was heated so that the internal temperature reached 80° C. After the temperature rise, a solution which was prepared by dissolving 10 g of potassium persulfate in 200 g of ion-exchanged water, and subsequently, the solution temperature was again elevated to 80° C. After dripping the following monomer mixture solution over one hour, the resulting mixture was heated while stirring at 80° C. for two hours to result in polymerization, whereby resin particles were produced. The resulting resin particles were designated as "Resin Particles B".

| | |
|---|---|
| Styrene | 520 g |
| n-Butyl acrylate | 210 g |
| Methacrylic acid | 68.0 g |
| n-Octanethiol | 16.0 g |

Some of Resin Particles B were collected, washed and dried, and Tg was then determined, resulting in 48° C.

(Preparation of Colorant Dispersion)

While stirring, 90 g of sodium dodecylsulfate was dissolved in 1600 ml of ion-exchanged water. While stirring the resulting solution, 420 g of C.I. Pigment Blue 15:3 was gradually added to the above solution. Subsequently, the resulting mixture was dispersed employing stirrer "CLEAR MIX" (produced by M Technique Co., Ltd.), whereby a colorant particle dispersion was prepared. The prepared dispersion was designated as "Colorant Dispersion 1". The diameter of colorant particles in the above Colorant Dispersion 1 was determined employing electrophoretic light scattering photometer "ELS-800" (produced by Otsuka Electronics Co., Ltd.), resulting in 1,100 nm.

(Aggregation-Fusion Process)

Placed in a 5 L reaction vessel fitted with a stirrer, a thermal sensor, a cooling pipe, and a nitrogen introducing unit were 300 g in terms of solid of Resin Particles A, 1,400 g of ion-exchanged water, 120 g of "Colorant Dispersion 1", and a solution which was prepared by dissolving 3 g of sodium polyoxyethylene (2) dodecyl ether sulfate. After regulating the resulting mixture to 30° C., the pH was regulated to 10 by adding a 5 N sodium hydroxide aqueous solution. Subsequently, while stirring, added was an aqueous solution which was prepared by dissolving 35 g of magnesium chloride in 25 ml of ion-exchanged water at 30° C. over 10 minutes. After maintaining that temperature for 3 minutes, the resulting mixture was heated to 90° C. over 60 minutes, and while maintaining the temperature at 90° C., particle growth reaction was allowed to continue. In such a state, the diameter of associated particles was determined employing "COULTER MULTISIZER 3". When median diameter in terms of volume standard reached 3.1 μm, 260 g of Resin Particles B dispersion was added and the particles were further allowed to grow. When the particle diameter reached the targeted value, particle growth was terminated by adding an aqueous solution which was prepared by dissolving 50 g of sodium chloride in 600 ml of ion-exchanged water. Further by heating the resulting mixture at 98° C. while stirring, fusion between particles was allowed to progress until the degree of circularity determined by FPIA-2100 reached 0.965. Thereafter, the temperature of the liquid composition was cooled to 30° C. followed by the adjustment of the pH to 4.0 by the addition of hydrochloric acid, and stirring was terminated.

(Washing-Drying Process)

Particles formed via the aggregation-fusion process were subjected to solid liquid separation employing basket type centrifuge "MARK III TYPE MODEL No. 60×40" (produced by Matsumoto Kikai Mfg. Co., Ltd.), whereby a wet cake of toner host particles was formed. The above cake was washed with ion-exchanged water at 45° C., employing the above basket type centrifuge until the conductivity of the filtrate reached 5 μS/cm. Thereafter, the resulting cake was placed in "FLASH JET DRYER" (produced by Seishin Enterprise Co., Ltd.) and dried to realize a water content of 0.5% by weight, whereby Toner Host Particles 1 were prepared.

(Preparation of Toner Host Particles 2)

Toner host particles 2 were prepared in the same manner as Toner host Particles 1, except that the weight of styrene and n-butyl acrylate, each of which was employed as a polymerizable monomer in the second stage polymerization of Resin Particles A, was changed to 245 g, and 120 g, respectively, while the weight of styrene, n-butyl acrylate, and methacrylic acid, each of which was employed as a polymerizable monomer in the third stage polymerization was changed to 423 g, 144 g, and 33 g, respectively.

(Preparation of Toner Host Particles 3)

Toner Host Particles 3 were prepared in the same manner as Toner Host Particles 1, except that the weight of styrene and n-butyl acrylate, each of which was employed as a polymerizable monomer in the second stage polymerization of Resin Particles A, was changed to 263 g, and 102 g, respectively, while the weight of styrene, n-butyl acrylate, and methacrylic acid, each of which was employed as a polymerizable monomer in the third stage polymerization was changed to 423 g, 144 g, and 33 g, respectively.

(Preparation of Toner Host Particles 4)

Toner Host Particles 4 were prepared in the same manner as Toner Host Particles 1, except that the weight of styrene and n-butyl acrylate, each of which was employed as a polymerizable monomer in the second stage polymerization of Resin Particles A, was changed to 274 g and 91 g, respectively, and in the aggregation-fusion process, the added amount of the dispersion of Resin Particles B was changed to 300 g.

(Preparation of Toner Host Particles 5)

Toner Host Particles 5 were prepared in the same manner as Toner Host Particles 1, except that in the aggregation-fusion process, Resin Particles B were not added.

(Preparation of Toners 1-5)

Hydrophobic silica (at a number average diameter of the primary particles of 12 nm) and hydrophobic titania (at a number average diameter of the primary particles of 20 nm) were added to each of Toner Host Particles 1-5, prepared as above, to result in 1% by weight and 0.3% by weight, respectively. The resulting mixture was blended employing a Henschel mixer, whereby Toners 1-5 were prepared. Tg and Fr of each of Toners 1-5 were determined based on the above described determination methods. Table 1 shows the determined values.

TABLE 1

| | Tg (° C.) | Fr (N) |
|---|---|---|
| Toner 1 | 22 | 3.4 |
| Toner 2 | 33 | 2.5 |
| Toner 3 | 40 | 1.3 |
| Toner 4 | 46 | 0.9 |
| Toner 5 | 22 | 4.7 |

(Preparation of Developers)

Ferrite carriers having a volume average diameter of 40 μm covered with silicone resins were mixed with each of the toner particles listed in Table 1, and Developers 1-5 at a toner concentration of 6% were prepared.

(Fixing Device)

In the fixing device shown in FIG. 4, one, in which PFA (tetrafluoroethylene-perfluoroalkyl vinyl ether) was employed in the endless belt fixing member, was designated as Fixing Device 1, while the other, in which PTFE (polytetrafluoroethylene) was employed, was designated as Fixing Device 2. Both Fixing Device 1 and Fixing Device 2 have a nip width of 20 mm. The fixing device shown in FIG. 5 was designated as Fixing Device 3.

<Evaluation>

Subsequently, image evaluation was carried out as follows. By employing a commercial complex machine "BIZHUB PRO C500 (produced by Konica Minolta Business Technologies, Inc.), images were outputted employing a single cyan color toner, and the resulting images were evaluated. The toner was loaded in the above Fixing Devices 1 or 2. Employed as a transfer medium, was OK TOP COAT+ (at 127.9 g/m$^2$ in A3 size, produced by Oji Paper Co., Ltd.), being a cardboard coated paper.

(Evaluation of Blister Defects)

With regard to image evaluation, a 2 cm×5 cm solid image was printed to result in a high toner adhesion amount of 12.5±0.5 g/m$^2$, and the resulting image was evaluated. The resulting solid images, prepared as above, were visually evaluated based on the following criteria.

A: no blistered image areas were noted

B: blistered image areas were noted but not markedly

C: blistered image areas were noted at a problematic level, being regarded as defective images (Evaluation of Cyclic Non-Uniform Glossiness)

With regard to image evaluation, a halftone image was printed on the whole surface of 10 card board coated paper sheets to result in a toner adhesion amount of 5.0±0.5 g/m$^2$, and the resulting images were evaluated.

With regard to the state of cyclic non-uniform glossiness of images to be evaluated, formation of cyclic non-uniform glossiness was visually evaluated based on the following criteria.

A: no cyclic non-uniform glossiness was noted

B: slight cyclic non-uniform glossiness was noted but was at a level in which commercial viability was rarely problematic C: cyclic non-uniform glossiness was obvious at a level in which solid images resulted in a sense of imperfection Table 2 shows the summary of the above evaluation results.

(Measurement of Fixing Rate)

The above-described samples having a solid image with a high toner adhesion amount used for evaluation of blister defects were used to evaluate the fixing rate.

First, the image density of the solid images were measured using with a Macbeth reflecting densitometer (RD-918). The image density is a relative density with respect to a white paper reference. The measured portion of each sample was wiped 14 times with a bleached cotton plain woven by giving a loading of 22 g/cm.

The image density after subjected 14 times wiping was measured. The following rate was defined as Fixing Rate:

Fixing Rate=(Image density after wiping)/(Image density without wiping)×100.

The value over 80% is considered to have no problem for practical use.

TABLE 2

| | Toner No. | Fixing Device | Blister Defect | Cyclic Non-Uniform Glossiness | Fixing Rate (%) |
|---|---|---|---|---|---|
| Example 1 | 1 | 1 | A | B | 98 |
| Example 2 | 2 | 1 | A | A | 95 |
| Example 3 | 3 | 1 | A | A | 91 |
| Example 4 | 2 | 2 | A | B | 95 |
| Comparative Example 1 | 4 | 1 | C | C | 70 |
| Comparative Example 2 | 5 | 1 | B | C | 98 |
| Comparative Example 3 | 1 | 3 | A | A | 73 |

TABLE 2-continued

| | Toner No. | Fixing Device | Blister Defect | Cyclic Non-Uniform Glossiness | Fixing Rate (%) |
|---|---|---|---|---|---|
| Comparative Example 4 | 2 | 3 | A | A | 70 |
| Comparative Example 5 | 3 | 3 | B | A | 64 |
| Comparative Example 6 | 4 | 3 | C | A | 58 |
| Comparative Example 7 | 5 | 3 | B | A | 73 |

As can be clearly be seen from Table 2, the examples according to the image forming method of the present invention exhibited excellent performance such as no formation of either blister defects or excellent (A) or good (B) evaluation for cyclic non-uniform glossiness.

What is claimed is:

1. A method of forming an image comprising the steps of:

developing an electrostatic latent image formed on an electrophotographic photoreceptor with an electrophotographic toner so as to obtain a toner image;

transferring the toner image on the electrophotographic photoreceptor to a recording sheet; and fixing the transferred toner image with a fixing member comprising a belt fixing member having an endless belt, wherein the electrophotographic toner exhibits a glass transition point of 20 to 40° C.;

an interfacial adhesion force ($F_R$) between the electrophotographic toner and poly(tetrafluoroethylene) is 1 to 3.5 N;

the electrophotographic toner has:

(i) a core/shell structure in which resin particles having a higher glass transition point than the electrophotographic toner are located near a surface of the electrophotographic toner, or (ii) a dispersed structure in which the resin particles having a higher glass transition point than the electrophotographic toner are dispersed in an interior of the electrophotographic toner; and the fixing member comprises a heating roller which is provided at a position apart from a fixing nip area.

2. The method of forming an image of claim 1, wherein the interfacial adhesion force ($F_R$) between the electrophotographic toner and poly(tetrafluoroethylene) is 1 to 3.0 N.

3. The method of forming an image of claim 1, wherein the electrophotographic toner comprises a polymer having a glass transition point of 20 to 30° C.

4. The method of forming an image of claim 1, wherein the interfacial adhesion force ($F_R$) between the electrophotographic toner and poly(tetrafluoroethylene) is 1 to 3.5 N; and the electrophotographic toner comprises a polymer having a glass transition point of 20 to 30° C.

5. The method of forming an image of claim 1, wherein the electrophotographic toner has a degree of circularity of 0.950 to 0.980.

6. The method of forming an image of claim 1, wherein the toner contains toner particles having a diameter of 3 to 8 μm in terms of number average particle diameter.

7. The method of forming an image of claim 1, wherein the toner is made of resin A and resin B, a glass transition temperature of resin B is higher than a glass transition temperature of resin A.

8. The method of forming an image of claim 5, wherein a weight ratio of resin B to resin A is between 10:90 and 80:20.

9. The method of forming an image of claim 1, wherein the toner has a core-shell structure.

10. The method of forming an image of claim 1, wherein the endless belt in the belt fixing member comprises a surface layer having a fluorinated resin.

11. The method of forming an image of claim a 10, wherein the fluorinated resin in the surface layer is a tetrafluoroethylene-perfluoroalkyl vinyl ether copolymer.

* * * * *